US007004632B2

(12) United States Patent
Hamilton et al.

(10) Patent No.: US 7,004,632 B2
(45) Date of Patent: Feb. 28, 2006

(54) VENTABLE STORAGE BAG

(75) Inventors: Peter Hamilton, Cincinnati, OH (US); Michael Borchardt, Naperville, IL (US); Rebecca Giesfeldt, Chicago, IL (US); Kenneth S. McGuire, Cincinnati, OH (US)

(73) Assignee: The Glad Products Company, Oakland, CA (US)

( * ) Notice: Subject to any disclaimer, the term of this patent is extended or adjusted under 35 U.S.C. 154(b) by 116 days.

(21) Appl. No.: 10/404,251

(22) Filed: Mar. 31, 2003

(65) Prior Publication Data

US 2004/0188310 A1 Sep. 30, 2004

(51) Int. Cl.
*B65D 33/01* (2006.01)

(52) U.S. Cl. ..... 383/103; 383/100; 383/45; 383/48; 383/63

(58) Field of Classification Search ..... 383/100, 383/103, 43–45, 48, 50, 51, 63; 206/524.8
See application file for complete search history.

(56) References Cited

U.S. PATENT DOCUMENTS

| | | | | |
|---|---|---|---|---|
| 1,809,259 | A | | 6/1931 | Williams |
| 2,445,487 | A | | 7/1948 | Lester et al. |
| 3,102,676 | A | | 9/1963 | Danelli et al. |
| 3,237,844 | A | | 3/1966 | Hughes |
| 3,302,859 | A | | 2/1967 | Perry |
| 3,378,189 | A | | 4/1968 | Dickson |
| 3,381,887 | A | | 5/1968 | Lowry |
| 3,432,087 | A | | 3/1969 | Costello |
| 3,494,457 | A | | 2/1970 | Titchenal |
| 3,519,197 | A | | 7/1970 | Campbell |
| 3,528,600 | A | | 9/1970 | White |
| 3,746,215 | A | | 7/1973 | Ausnit et al. |
| 3,759,722 | A | | 9/1973 | Simon |
| 3,937,395 | A | | 2/1976 | Lawes |
| 3,980,226 | A | | 9/1976 | Franz |
| 3,989,853 | A | | 11/1976 | Forkner |
| 4,122,993 | A | | 10/1978 | Glas |
| 4,134,535 | A | | 1/1979 | Barthels et al. |
| 4,137,333 | A | | 1/1979 | Daswick |
| 4,141,487 | A | | 2/1979 | Faust et al. |
| 4,192,448 | A | | 3/1980 | Porth |
| 4,206,870 | A | * | 6/1980 | DeVries ..... 383/103 |
| 4,260,060 | A | | 4/1981 | Faller |
| 4,276,982 | A | | 7/1981 | Sibrava et al. |
| 4,310,118 | A | | 1/1982 | Kisida et al. |
| 4,318,506 | A | | 3/1982 | Hirsch |
| 4,404,241 | A | | 9/1983 | Mueller et al. |
| 4,419,373 | A | | 12/1983 | Oppermann |
| 4,426,401 | A | | 1/1984 | Otow et al. |
| 4,441,209 | A | | 4/1984 | Lunshof et al. |
| 4,449,242 | A | | 5/1984 | Sliney, Jr. |
| 4,461,420 | A | | 7/1984 | Horvath |
| 4,468,811 | A | | 8/1984 | Shaw et al. |
| 4,470,153 | A | | 9/1984 | Kenan |

(Continued)

FOREIGN PATENT DOCUMENTS

| | | |
|---|---|---|
| JP | 406099991 | 4/1994 |

(Continued)

*Primary Examiner*—Robin A. Hylton
(74) *Attorney, Agent, or Firm*—Thomas C. Feix

(57) ABSTRACT

A storage bag for food products with a venting structure to expel excess air trapped inside the bag after the bag has been closed or sealed. After the excess air is removed, the venting structure is covered and sealed to prevent air from re-entering the bag or other objects from entering the bag.

37 Claims, 12 Drawing Sheets

U.S. PATENT DOCUMENTS 4,491,224 A 1/1985 Horvath
4,513,445 A 4/1985 Kamp
4,530,440 A 7/1985 Leong
4,548,824 A 10/1985 Mitchell et al.
4,550,441 A 10/1985 Keppel
RE32,018 E 11/1985 Domke et al.
4,576,283 A 3/1986 Fafournoux
4,581,764 A 4/1986 Plock et al.
4,640,838 A 2/1987 Isakson et al.
4,653,661 A 3/1987 Buchner et al.
4,709,399 A 11/1987 Sanders
4,759,472 A 7/1988 Stenger
4,759,494 A 7/1988 Smyth
4,759,643 A 7/1988 Canno
4,779,736 A 10/1988 Geasland
4,785,940 A 11/1988 Wilson
4,817,815 A 4/1989 Stahlecker
4,834,554 A 5/1989 Stetler, Jr. et al.
4,874,620 A 10/1989 Mendenhall et al.
4,890,637 A 1/1990 Lamparter
4,904,489 A 2/1990 Bach
4,961,944 A 10/1990 Matoba et al.
5,004,449 A 4/1991 Ojima
5,007,662 A 4/1991 Abramczyk et al.
5,059,036 A 10/1991 Richison et al.
5,117,999 A 6/1992 Canzano et al.
5,201,459 A 4/1993 Bettle, Jr. et al.
5,203,458 A 4/1993 Cornwell
5,205,649 A 4/1993 Fullerton
D338,399 S 8/1993 Conte, Jr.
5,240,112 A 8/1993 Newburger
5,263,777 A 11/1993 Domke
5,308,666 A 5/1994 Borchardt
5,326,176 A 7/1994 Domke
5,348,217 A 9/1994 Bettle, Jr. et al.
5,362,152 A 11/1994 Fletcher et al.
5,376,424 A 12/1994 Watanabe
5,511,884 A 4/1996 Bruno et al.
5,540,500 A 7/1996 Tanaka
5,558,441 A 9/1996 Morrison et al.
5,587,192 A 12/1996 Beizeermann
5,620,256 A 4/1997 Makrauer
5,662,758 A 9/1997 Hamilton et al.
5,672,009 A 9/1997 Malin
5,701,996 A 12/1997 Goto et al.
5,720,557 A 2/1998 Simonsen
5,741,075 A 4/1998 Collins et al.
5,774,955 A 7/1998 Borchardt et al.
5,785,428 A 7/1998 Mazzocchi
5,806,703 A 9/1998 Grandi
5,829,884 A 11/1998 Yeager
5,839,582 A 11/1998 Strong et al.
5,855,434 A 1/1999 Hagen
5,871,607 A 2/1999 Hamilton et al.
5,881,881 A 3/1999 Carrington
5,908,243 A 6/1999 Hanning
5,911,508 A 6/1999 Dobreski et al.
5,954,433 A 9/1999 Yeager
5,965,235 A 10/1999 McGuire et al.
5,973,768 A 10/1999 Mazion et al.
5,980,108 A 11/1999 Pasbrig
5,992,442 A 11/1999 Urquhart et al.
5,992,635 A 11/1999 Walters
5,996,800 A 12/1999 Pratt
6,010,244 A 1/2000 Dobreski et al.
6,012,844 A 1/2000 Huseman et al.
6,021,624 A 2/2000 Richison et al.
6,023,914 A 2/2000 Richison
6,024,709 A 2/2000 Stark et al.
6,039,182 A 3/2000 Light
6,059,457 A 5/2000 Sprehe et al.
6,070,397 A 6/2000 Bachhuber
6,085,906 A 7/2000 Lambert
6,116,781 A 9/2000 Skeens
6,126,975 A 10/2000 Archibald et al.
6,135,637 A 10/2000 Kim
6,149,304 A 11/2000 Hamilton et al.
6,156,363 A 12/2000 Chen et al.
6,170,985 B1 1/2001 Shabram, Jr. et al.
6,183,134 B1 2/2001 Malin
6,189,694 B1 2/2001 Weiss et al.
6,194,062 B1 2/2001 Hamilton et al.
6,213,645 B1 4/2001 Beer
6,214,392 B1 4/2001 Ramirez
6,224,262 B1 5/2001 Hogan et al.
6,227,706 B1 5/2001 Tran
6,231,236 B1 5/2001 Tilman
6,270,257 B1 8/2001 Yeager
6,274,181 B1 8/2001 Richison et al.
6,286,681 B1 9/2001 Wilfong, Jr. et al.
6,299,353 B1 10/2001 Piechocki et al.
6,357,915 B1 3/2002 Anderson
6,380,524 B1 4/2002 Keller
6,423,356 B1 7/2002 Richison et al.
6,467,957 B1 10/2002 Yeager
6,471,403 B1 10/2002 Janssen
6,481,891 B1 11/2002 Yeager
6,489,022 B1 12/2002 Hamilton et al.
6,505,383 B1 1/2003 Machacek et al.
D471,088 S 3/2003 Kinigakis et al.
2001/0046334 A1 11/2001 Yeager
2002/0009240 A1 1/2002 Anderson
2002/0090151 A1 7/2002 Skeens et al.
2002/0191870 A1 12/2002 Richison et al.
2003/0068101 A1 4/2003 Huseman et al.
2003/0072504 A1 4/2003 Strand et al.
2004/0000502 A1 * 1/2004 Shah et al.
2004/0000503 A1 * 1/2004 Shah et al.

FOREIGN PATENT DOCUMENTS

JP 1-111685 * 4/1998

* cited by examiner

VENTABLE STORAGE BAG

FIELD OF THE INVENTION

The present invention relates to storage bags and specifically to a ventable storage bag for expelling unwanted air trapped internally by the bag.

BACKGROUND OF THE INVENTION

Storage bags are a common household product used throughout the world. Storage bags are conventionally used to store food products in a refrigerator, freezer, portable cooler for camping, picnics, backyard barbecues, or similar type occasions, or even in kitchen cabinets. Stored food items may include, for example, fruits, deli meats, poultry, bread, cheese, beef, sauces, chips, nuts, sugar, flour, and the like. Storage bags may also be used to store various other items such as cosmetic applicators, personal care items, pills, screws or nails, batteries, and the like. Such bags are often made of a flexible material such as plastic, and therefore may be preferred for storage use over a hard-sided container. That is because the size of the flexible bag may be adjusted to match the space required to store the bag's contents, whereas if a hard-sided container is only half full, the empty half is just wasted space.

One difficulty with conventional storage bags is air can get trapped inside the bag as the user closes the bag. This decreases the shelf-life or storage longevity of a stored product. Particularly, when the storage bag stores a food product and is placed in a freezer, excess air in the bag may cause desiccation (commonly known as freezer burn) thus spoiling the stored food product. Some persons have tried to solve the problem of unwanted, excessive air inside a storage bag by vacuum sealing the bag. This process requires a machine to vacuum or pump the excess air out of the bag and may take up to several minutes to seal each bag. The machine, while taking up a great deal of counter-top or kitchen-top space, creates noise. In addition, conventional vacuum sealing machines can be expensive and thus may not be affordable to the average consumer.

Another problem with storage bags is that the air trapped inside a bag increases the size of the bag, therefore taking up more space in the refrigerator, freezer, cooler, shelf, or box that is strictly required to store the contents of the bag. For a user with limited storage space or a shipping company that wants to maximize storage space use, and therefore profits, unnecessary air inside the storage bag is undesirable. This problem may be resolved only with complicated, and time consuming, manipulation of the bag to squeeze out the air as the bag is closed.

It has been known to utilize a package valve in an attempt to overcome these or similar problems. Many of these prior valves, however, are difficult and expensive to manufacture in that multiple pieces must be made, handled, and assembled. As will be understood to one of ordinary skill, storage bags may conveniently be manufactured by sealing and cutting a continuous plastic web as it is formed at high speeds. At such high speeds, placing a valve in the bags in a consistent position presents several technical difficulties. Inevitably this will require a slower moving web, as well as complicate the manufacturing process, leading to reduced production capacity at an increased cost. Exemplary package valves are disclosed in U.S. Pat. No. 3,432,087 to Costello.

Accordingly, it would be beneficial to have a storage bag that is cost efficient to make and use, easy to manufacture, increases the shelf or storage life of a stored product, conserves space and is easy to use.

SUMMARY OF THE INVENTION

The present invention is a bag for storing products with a front wall, a back wall, and a storage space defined between the front wall and the back wall. The bag includes an opening at a top of the bag with a closure mechanism. One or more first perforations are located in the front wall proximate to the opening and beneath the closure mechanism. A cover is positioned over the one or more first perforations having a surface facing away from the bag and a surface facing towards the bag. The bag further includes an adhesive positioned proximate to the top of the bag.

Further, the present invention is a bag for storing products. The bag includes a front wall, back wall, and a storage space defined between the front wall and the back wall with an opening at a top of the bag for inserting products into the storage space. The bag includes a closure mechanism for closing the opening. One or more first perforations are located in the front wall proximate to the opening and beneath the closure mechanism for permitting air trapped within the storage space to escape. A cover is positioned over the one or more first perforations for sealing the bag after air trapped within the storage space has escaped. The cover is an integral extension to the front wall of the bag. The cover includes a front surface facing away from the bag, a back surface facing towards the bag, a top edge, a bottom edge, and two side edges, with the bottom edge and the two side edges of the cover being secured to the bag. An adhesive is secured to the bag. One or more second perforations are above the one or more first perforations, with a portion of the adhesive located between the first and the second perforations.

Still further, the present invention is a bag for storing products. The bag includes a front wall, a back wall, and a storage space defined between the front wall and the back wall. An opening at a top of the bag is for inserting products into the storage space with a closure mechanism for closing the opening. One or more first perforations are located in the front wall proximate to the opening and beneath the closure mechanism for permitting air trapped within the storage space to escape. A cover is positioned over the one or more first perforations for sealing the bag after air trapped within the storage space has escaped, with the cover being a separate piece from the bag and including an adhesive material.

Even further, the present invention is a method of expelling air from a storage bag. The method includes the steps of applying pressure to a closed storage bag filled with trapped air, so air travels through perforations on a surface of the bag, breaking an adhesive seal for the perforations, and exits through an opening to atmosphere created by the breaking of the seal.

DETAILED DESCRIPTION OF THE PREFERRED EMBODIMENTS

Figure 1:
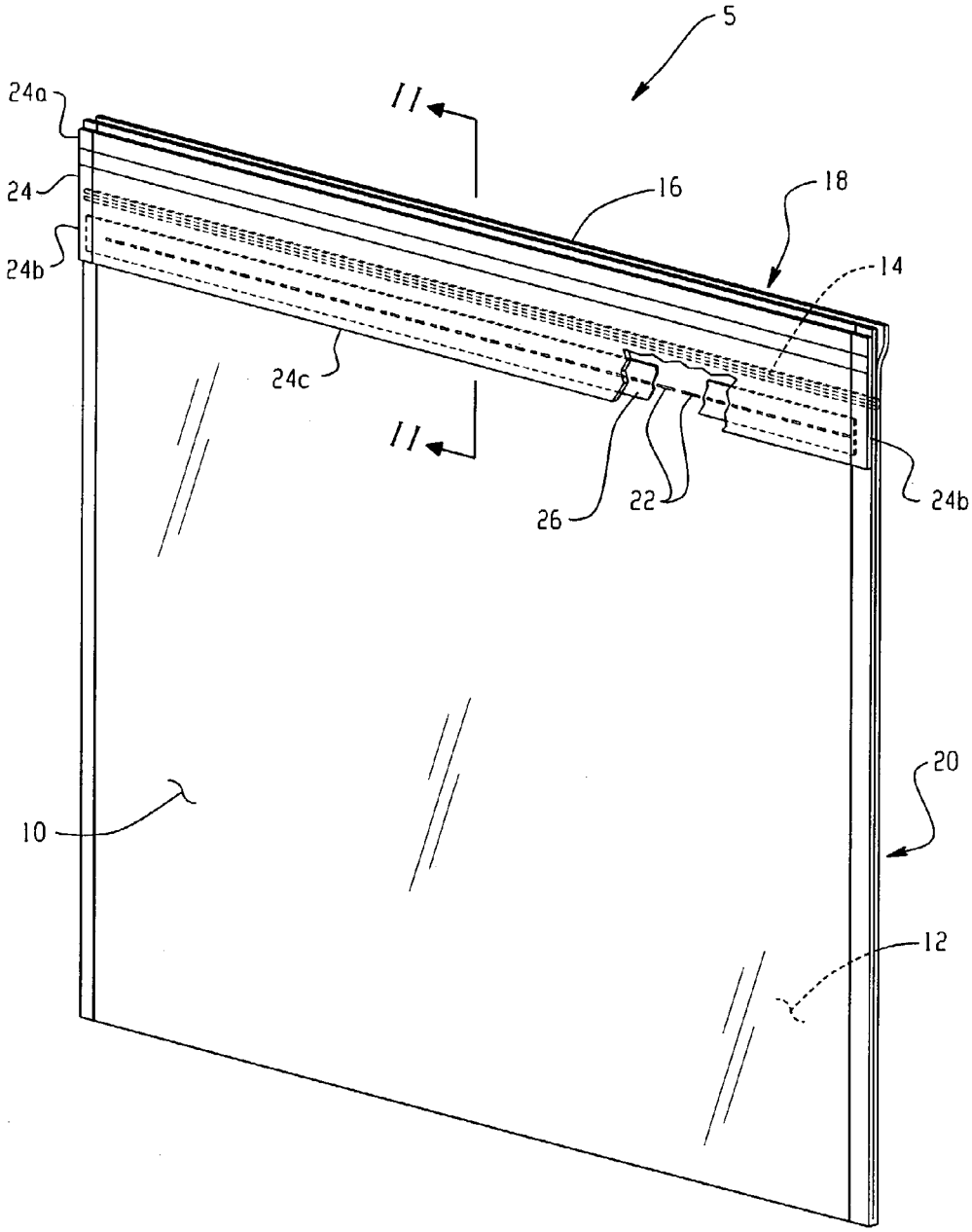
FIG. 1 shows a perspective view of a storage bag with a vent cover being a separate piece from the bag.

With reference to the FIGS., wherein like reference numerals refer to like elements, exemplary embodiments of the present invention provide a venting structure for use in storage bags in order to free air trapped inside the bag after products are placed inside the bag and the bag is closed.

The exemplary embodiments of the present invention help to alleviate the problem of desiccation, which is commonly referred to as freezer burn, created by the presence of air and the build-up of air pressure in the storage bag by providing vents on the bag. If air pressure is increased inside the bag, vents operate to reduce the air pressure by releasing the internal air out from the storage bag and to the environment. In addition, the present invention overcomes the problem created by air in the storage bag causing excessive space to be taken up by the bag. Releasing air from inside the bag through the vents will reduce the volume of the bag and therefore conserve space.

As will be described, the design of the exemplary embodiments of this invention provides multiple means by which excessive air pressure can be expelled from the storage bag. As illustrated in FIG. 1, and generally applicable to all embodiments, a storage bag 5 may have a front wall 10 and a back wall 12 for storing products. The bag 5 is designed to be re-closeable, and re-sealable. Therefore, a consumer may use the bag 5 to store more products once its current contents are depleted, or to obtain access to the currently stored contents without having to re-store them in another bag.

The bag 5 is preferably made of a plastic film. The term "film" as used herein represents any three-dimensional material which possesses two opposite facing surfaces separated by edging surfaces. The opposite facing surfaces may be mono- or poly-planar and the combined surfaces typically (and preferably) possess many times the area of the edge surfaces. Films employed in the manufacture of storage bags are typically polyolefin thermoplastic films such as one or more layers of polyethylene (low density, high density, linear low density, ultra low density and/or combinations thereof), polypropylene, and polyethylene copolymers (low density, linear low density, ultra low density, high density and/or combinations). Polybutylenes, polyvinyl chloride (PVC), polyvinylidene chloride (PVDC), ABS polymers, polyurethanes, polycarbonates, polysulphones, aliphatic polyamides, polyarylamides, polyaryletherketones, polyarylimideamides, polyaryletherimides, polyesters, polyarylates, polyoxymethylene, poly(epsilon-caprolactone), and the like, alone or composited with a variety of materials, such as metal films, paper, cardboard, textile structures, non-woven materials, wood, and the like may also be used.

The structure of a re-closable, re-sealable bag 5 may be accomplished by using one of several closure mechanisms, either alone or in combination with one another. In the preferred embodiment, an interlocking closure (ILC) 14 is used as the closure mechanism for the opening of the bag 5. The ILC 14 is shown somewhat schematically in FIGS. 1–11. Generally speaking, the ILC 14 includes a pair of fastening strips provided with inter-engaging closure profiles. The interlocking fastening strips may be manufactured by extrusion through a die and may be formed from any suitable thermoplastic material including, for example, polyethylene, polypropylene, nylon, or the like, or from a combination thereof. Thus, resins or mixtures of resins such as high-density polyethylene, medium-density polyethylene, and low-density polyethylene may be employed to prepare the interlocking fastening strips. When the fastening strips are used in a sealable bag 5, the fastening strips and the films that form the body of the bag 5 may be conveniently manufactured from heat sealable material. In this way, the bag 5 may be economically formed by using an aforementioned thermoplastic material and by heat sealing the fastening strips to the bag 5. For example, the bag 5 may be made from a mixture of high pressure, low-density polyethylene and linear, low-density polyethylene. The fastening strips may be manufactured by extrusion or other known methods. For example, the closure device may be manufactured as individual fastening strips for later attachment to the bag 5 or may be manufactured integrally with the bag 5. In addition, the fastening strips may be manufactured with or without flange portions on one or both of the fastening strips depending upon the intended use of the fastening strips or expected additional manufacturing operations. Generally, the fastening strips can be manufactured in a variety of forms to suit the intended use. The fastening strips may be integrally formed on the opposing sidewalls of a container or bag 5, or connected to the container by the use of any of several known methods. For example, a thermoelectric device may be applied to a film in contact with the flange portion of the fastening strips or the base portion of fastening strips having no flange portion, to cause a transfer of heat through the film to produce melting at the interface of the film and a flange portion or base portion of the fastening strips. Suitable thermoelectric devices include heated rotary discs, traveling heater bands, resistance-heated slide wires, and the like. The connection between the film and the fastening strips may also be established by the use of hot melt adhesives, hot jets of air to the interface, ultrasonic heating, or other known methods. The securing of the fastening strips to the film stock may be carried out either before or after the film is U-folded to form the bag 5. In any event, such securing may be done prior to side sealing the bag 5 at the edges by conventional thermal cutting. In addition, the first and second fastening strips may be positioned on opposite sides of the film. Such an embodiment would be suited for wrapping an object or a collection of objects such as wires. The first and second fastening strips should usually be positioned on the film in a generally parallel relationship with respect to each other, although this will depend on the intended use.

Additional examples of suitable closure mechanisms include a slider device that seals an interlocking closure, tape, hook and loop fasteners, adhesives applied to the bag 5 near the mouth of the bag 5, or an adhesive material formed integrally with the bag itself, as described in U.S. Pat. No. 6,149,304, which is hereby fully incorporated by reference in its entirety. Although the present description focuses on the preferred ILC closure mechanism, any of these alternative closure mechanisms may of course be utilized.

As shown in the figures, the ILC 14 is located near a top edge 16 of the bag 5. The ILC 14 is preferably integrally formed with the rest of the bag 5, as described in U.S. Pat. No. 5,774,955, which is hereby fully incorporated by reference in its entirety. The ILC 14 divides the front and back walls 10, 12 into two parts, a flange or handle portion 18 located above the ILC 14 for gripping the bag 5, and a storage portion 20 located below the ILC 14 for storing products in the bag 5. When the bag 5 is closed, the ILC 14 creates an air-tight seal to the storage portion 20, so that air, liquid, or the like cannot penetrate through the ILC 14.

In order to expel excess air from inside the bag 5 even when the ILC 14 is closed, a venting structure is incorporated in the bag 5. In the preferred embodiment, perforations 22 are formed in the bag 5 to create an exit from the bag 5 for the excess air. As shown in FIG. 1, the perforations 22 are located in the storage portion 20 of the bag 5 and are formed in a straight-line configuration. Representative alternative configurations for the perforations 22 are shown in FIGS. 13–17, respectively, as X-shapes 22*a*, cross-shapes 22*b*, half-moons or C-shapes 22*c*, S-shapes 22*d*, and discontinued circle shapes 22*e*. It is preferred that the perforations 22 are cuts, incisions, or the like as shown in those FIGS., rather than holes in the bag 5, although either may be used. The use of cuts greatly facilitates sealing of the venting structure after excess air is expelled (as described further below), and avoids producing waste bag material, such as a hole would, during manufacture.

Varying the number and/or configuration of the perforations 22 may lead to different surface areas being available for excess air to escape from the bag 5. One or more perforations may be used. It is preferred, however, to have several perforations each configured to have relatively short length cuts. Smaller-sized cuts are easier to seal than larger-sized cuts because the opening of a smaller-sized cut uses less surface area on the bag. Generally speaking, the greater the surface area, the greater the potential of leakage.

The perforations 22 preferably extend from one side of the bag 5 to the opposite side of the bag 5. A tremendous convenience in manufacturing storage bags is thus obtained when they are made by forming, sealing, and separating a continuously running plastic web film. The film roll moves in a machine direction (MD), defined as the long direction of the film roll. A transverse direction (TD) is defined as the short direction of the web film roll. If the perforations extend all the way across the bag 5, there is no specific location to find on the surface of individual bags along the machine direction. Thus, for example, the perforations may be formed in the moving film by a rotating die, pressure tool, or the like disposed just above (or below) the film which rotates with the movement of the film to create the perforations into the film, preferably in the direction of film movement. This allows the perforations to be easily placed along the entire width of the bag without worry of registration between the subsequently formed side seals.

A cover 24 may be placed over the perforations 22 to prevent air from re-entering the bag 5 after the air has been expelled from the bag 5, to discourage insects from possibly crawling inside the bag 5, and otherwise to help prevent the contents of the storage bag 5 from being contaminated. The cover 24 may be made from the same material as the bag 5 or a material that will permit securing by heat sealing, ultrasonic welding, etc. to the bag 5. In one embodiment, as shown in FIGS. 1–4, the cover 24 may be initially formed as a separate piece from the bag 5, and then attached as follows.

Figure 2:
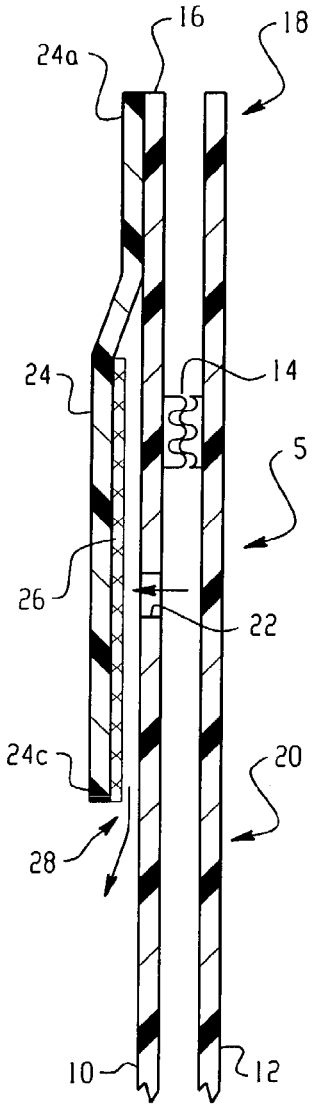
FIG. 2 shows a cross-sectional view taken along line II—II of FIG. 1.

As shown in FIGS. 1 and 2, a top edge 24*a* of the cover 24 is heat sealed, ultrasonically welded, or otherwise permanently secured to the bag 5 along with both side edges 24*b* of the cover 24. The top edge 24*a* of the cover 24 is permanently secured to the top edge 16 of the bag 5. In an alternative configuration (not shown), the top edge 24*a* of the cover 24 may be secured to the front wall 10 of the bag 5 below its top edge 16, or even below the ILC 14. A bottom edge 24*c* of the cover 24 has an adhesive strip 26 permanently secured to a surface of the cover 24 facing the bag 5. The adhesive strip 26 allows the bottom edge 24*c* of the cover 24 to be removably sealed to the front wall 10. The cover 24 also includes a surface facing away from the bag.

Several different types of adhesive 26 may be suitably used with the storage bags described here, depending on the intended use of the bag 5. For example, if the bag is intended for use in storing food products, the adhesive 26 is preferably a "food grade" adhesive. A hot melt pressure sensitive adhesive is generally acceptable. In particular, a pressure sensitive hot melt adhesive may be used, such as the H.B. Fuller Company's product number NW1007XZP. The adhesive used may be selected from a list of various types such as styrene-butadiene-styrene (SBS) block copolymers, acrylic based formulations, silicone based formulations or the like. Additionally, the form may be hot melt types as well as liquid emulsions, suspensions, or solvent formulae.

As the air is expelled from the bag 5 through the perforations 22 when the cover is not sealed to the front wall 10, illustrated by the arrows in FIG. 2, the air will enter the atmosphere at an opening 28 near the bottom edge 24*c* of the cover 24. If the adhesive 26 is initially sealed to the front wall 10, either the pressure of the air being forced from the inside of the bag 5 will break the seal or the user can manually lift the cover 24 with his fingers in order to create the opening 28 to the atmosphere. Once the air is expelled, the user may manually reseal the adhesive 26 to the front wall 10 by applying pressure to the cover 24 at points where the adhesive 26 has been applied. This embodiment shows the adhesive 26 as being located directly on top of and surrounding the perforations 22. The adhesive 26 may alternatively be applied at any point along the surface of the cover 24 facing the front wall 10 between the perforations 22 and the opening 28. The adhesive 26 may similarly be permanently secured to the front wall 10 for forming a removable seal with the surface of the cover 24 facing the front wall 10. In the embodiments described above in connection with FIGS. 2–3 and below in connection with FIGS. 6 and 12, the amount of air pressure alone that is needed to force a broad front break of the adhesive 26 overlying the perforations 22 can be significant. In practice, it is contemplated that the user will manually lift the cover 14 to break the seal and then squeeze the bag 5 to expel any trapped air from within the bag 5 through the now exposed perforations 22. This step is performed, of course, after the closure mechanism has been closed.

Figure 3:
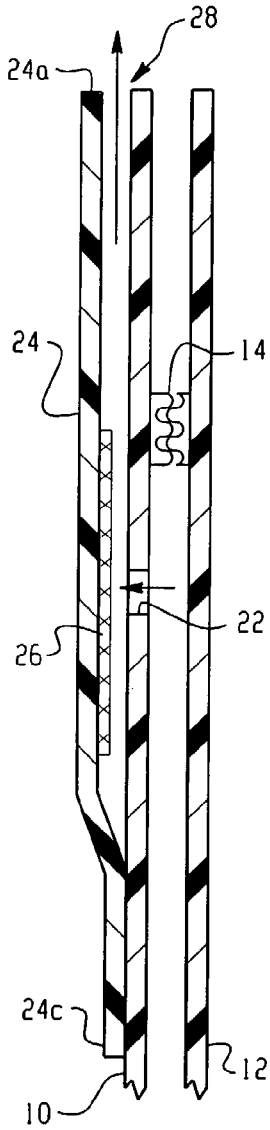
FIGS. 3 and 4 show cross-sectional views, similar to the view of FIG. 2, of other embodiments of the storage bag.

In FIG. 3, the opening 28 to the atmosphere is adjacent the top edge 24*a* of the cover 24 for the air inside the bag 5 to travel through, as illustrated by the arrows in FIG. 3. The bottom edge 24*c* and side edges 24*b* of the cover 24 are heat sealed, ultrasonically welded, or otherwise permanently secured to the bag 5. Adhesive 26 is permanently secured to the surface of the cover 24 facing the front wall 10 for removably sealing against the front wall 10. As described with respect to the FIG. 2 embodiment, the adhesive 26 need not cover the perforations, and the adhesive 26 may be permanently secured to the front wall 10 rather than the cover 24. In this embodiment, however, the adhesive 26 is preferably located at a distance from the perforations 22 (i.e., so as not to directly overlay the perforations 22) in order to facilitate the breaking of the releasable seal of the adhesive 26 by air pressure alone as the user is expelling trapped air from the bag 5. By locating the adhesive 26 away from the perforations 22, the user can more easily expel trapped air from the closed bag 5 by simply squeezing the bag since a lower force is needed to break the seal of adhesive 26 when it does not directly cover the perforations 22. The force of air expelled through the perforations 22 acting against the overlaying adhesive-free portion of the cover 26 generates a peel force which acts on the adjacent portion(s) of the cover 26 that are sealed to the front wall 10 by adhesive. The location of the adhesive 26 from the perforations defines a peel angle. In general, the peel angle is inversely related to the peel force required to break the adhesive seal. That is, the higher the peal angle, the lower the peal force required.

Figure 4:
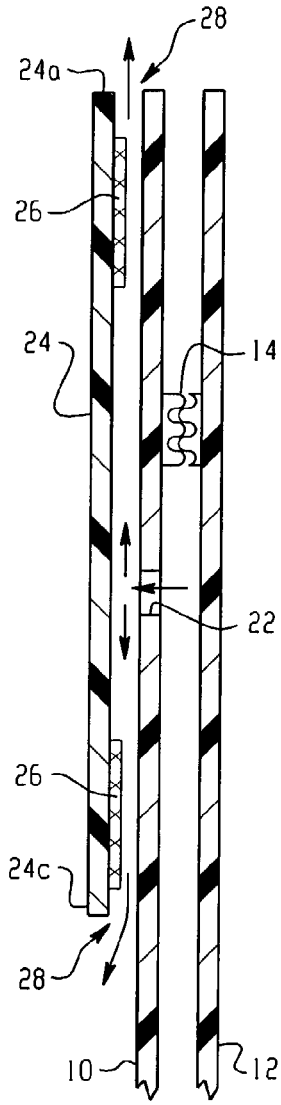

In FIG. 4, the top edge 24*a* and bottom edge 24*c* of the cover 24 create the opening 28 to atmosphere. The air can exit at the top edge or at the bottom edge or at both edges simultaneously. Only the side edges 24*b* of the cover 24 are heat sealed, ultrasonically welded, or otherwise permanently secured to the bag 5. Adhesive 26 is permanently secured to the surface of the cover 24 facing the front wall 10 for releasably sealing against the front wall 10, or vice versa.

Figure 5:
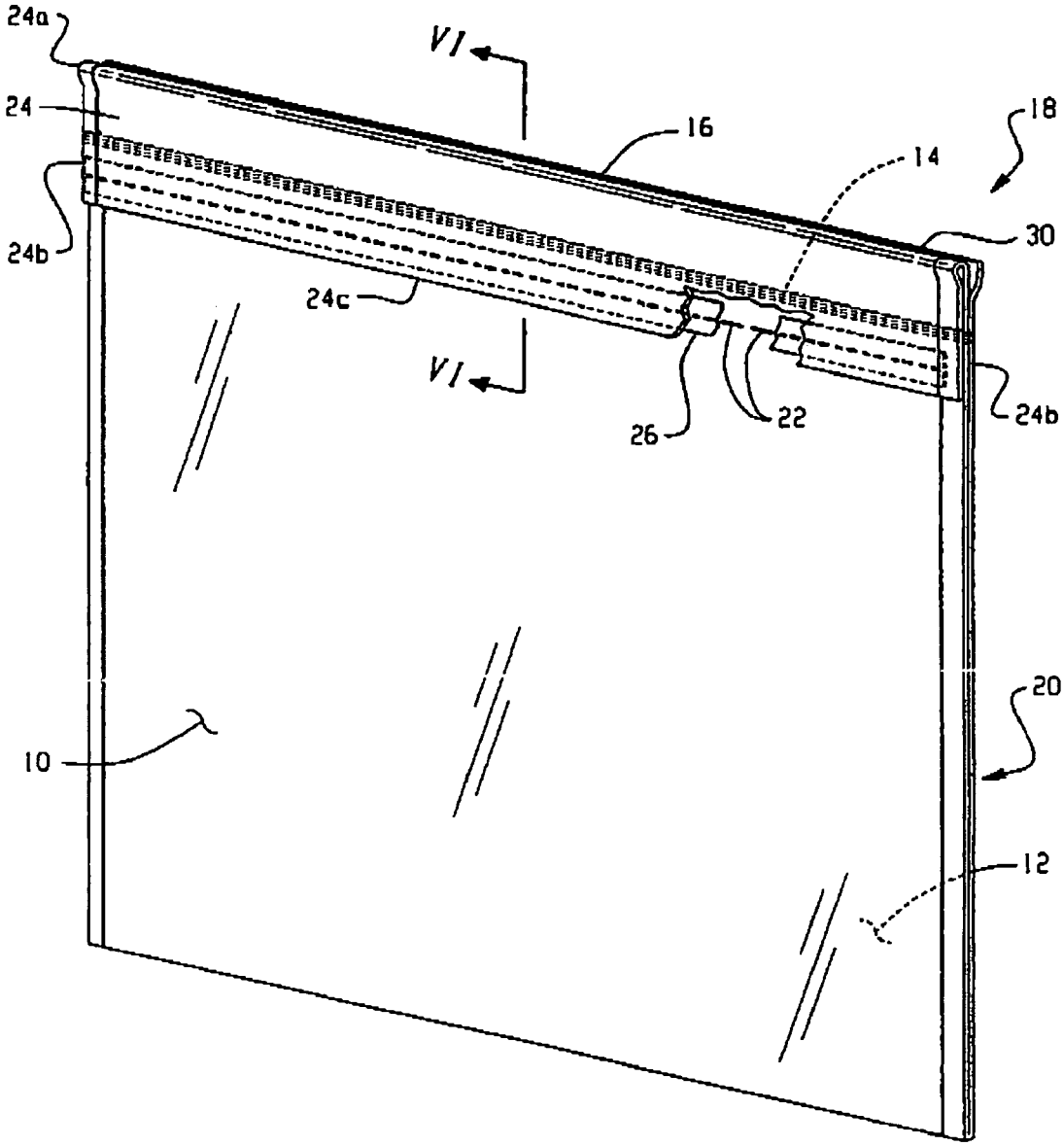
FIGS. 5 and 6 show another embodiment of a storage bag with a vent cover being an integral piece of the bag, with FIG. 6 showing a cross-sectional view taken along line VI—VI of FIG. 5.
Figure 6:
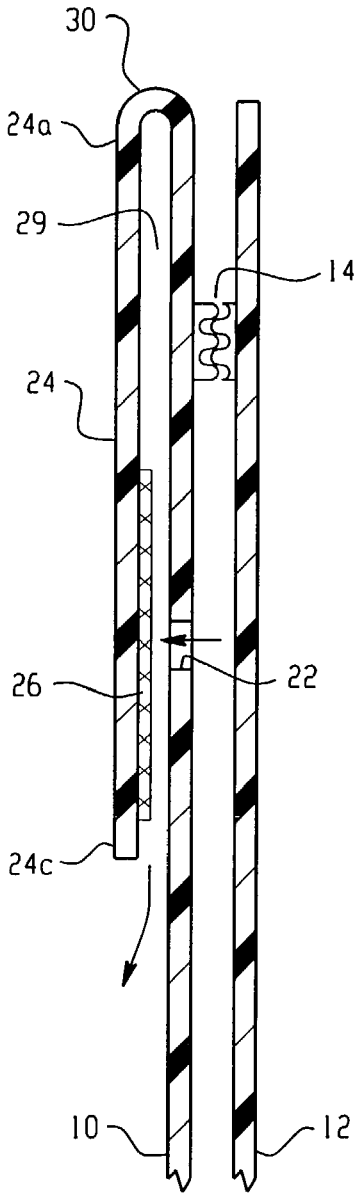

In the embodiment of FIG. 5, the cover 24 is formed as an integral element of the bag 5, being an extension of the flange portion 18 at a fold-over line 30. Because the cover 24 is extended from the flange portion 18, the top edge or terminal edge 24*a* of the cover 24 does not need to be secured to the bag 5. The air escapes to the atmosphere from inside the bag 5 near the bottom edge 24*c* of the cover 24, as illustrated by FIG. 6. Thus, this embodiment operates substantially the same as already described for the FIG. 2 embodiment.

Figure 8:
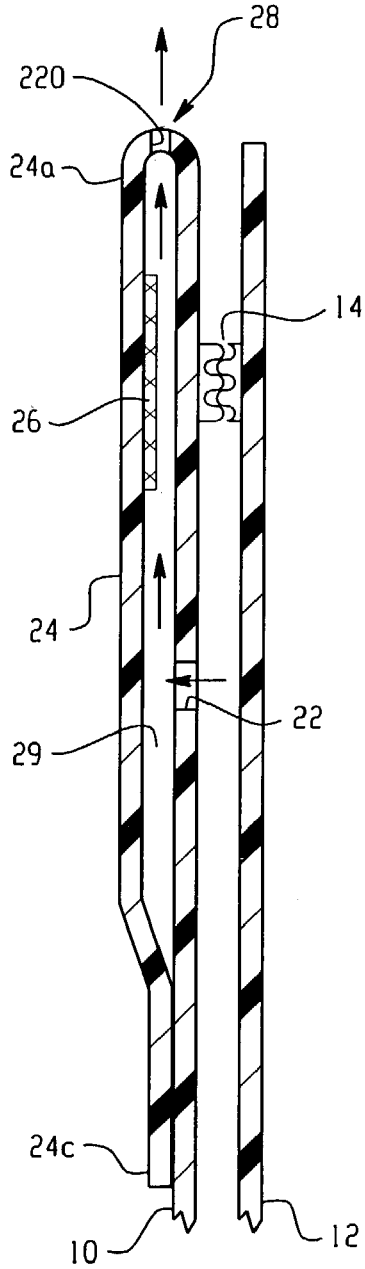
FIGS. 7 and 8 show an embodiment of a storage bag with a chamber venting structure, with FIG. 8 showing a cross-sectional view taken along line VIII—VIII of FIG. 7.
Figure 7:
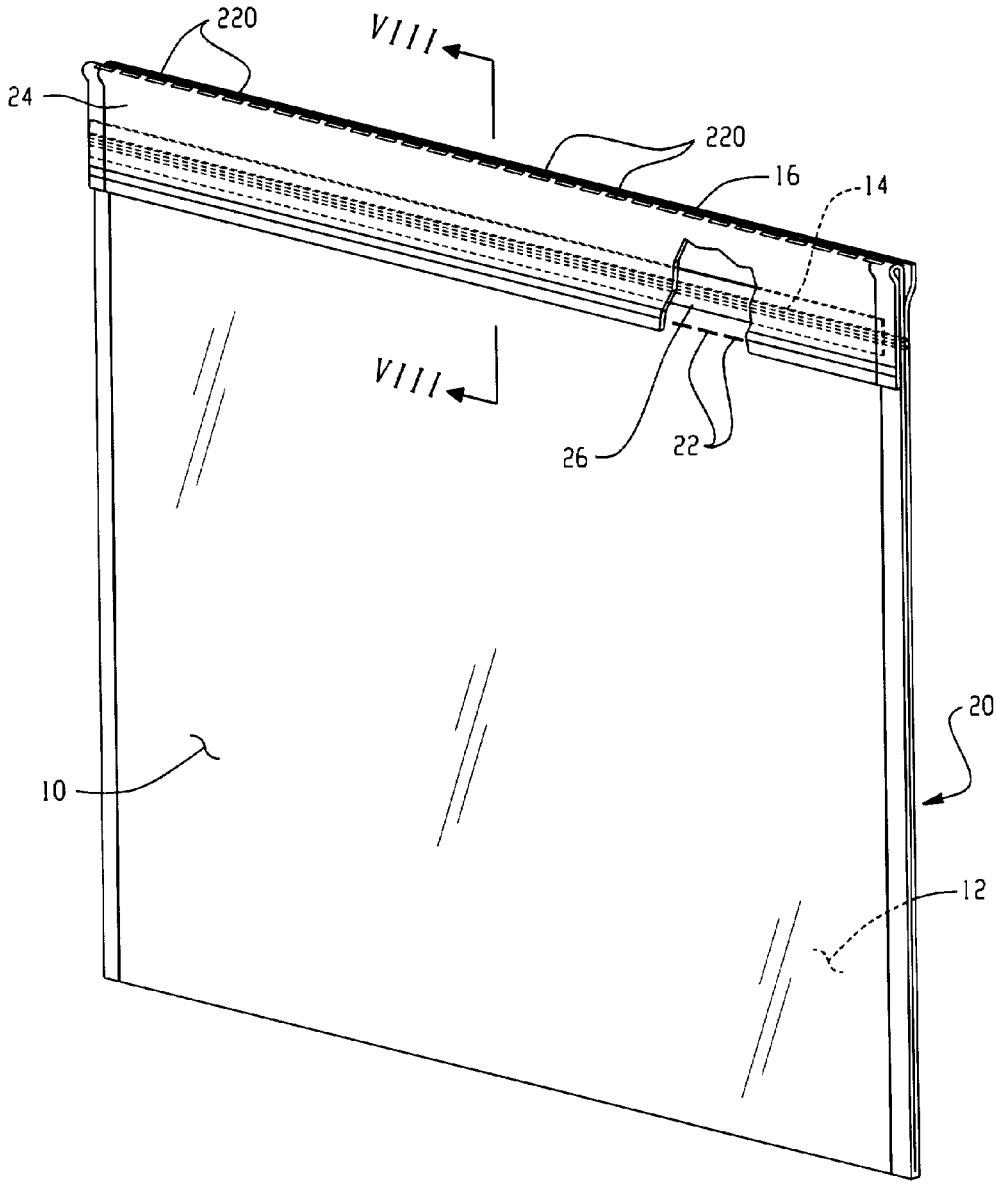

FIGS. 7 and 8 illustrate an alternative embodiment referred to herein as a chamber design of the storage bag 5. With respect to the chamber design, a second set of perforations 220 may be incorporated within the bag 5. The second set of perforations 220 function similarly to the opening 28 to the atmosphere as described above. As illustrated in FIGS. 7 and 8, the chamber design may include a cover 24 formed as an integral extension of the flange portion 18 [reference numeral 18 is missing from FIGS. 7–8] which is heat sealed, ultrasonically welded, or otherwise permanently secured to the front wall 10 at the bottom edge 24*c* and side edges 24*b* of the cover 24. Thus a chamber 29 is formed. The first set of perforations 22 is located below the ILC 14 and adhesive 26 so that air may pass between the chamber 29 and the storage portion 20 of the bag 5. The second set of perforations 220 is located along the fold-over line 30 so that air may pass between the chamber 29 and the atmosphere. Thus, when the adhesive 26 is not sealed to the front wall 10, air is free to exit from inside the bag 5 through the first set of perforations 22, travel into the chamber 29 up past the adhesive 26, and then through the second set of perforations 220 to the atmosphere.

After closing the bag 5 and expelling the excess internal air from the bag 5 of FIGS. 7 and 8, the user may apply pressure to the cover 24 at the ILC 14 to removably seal the cover 24 to the front wall 10, thus closing the air flow path from the first set of perforations 22 to the second set of perforations 220. In this way the adhesive 26 is removably sealed with a single swipe from the hands of a user across the top edge 16 of the bag 5, similar to the method of closing the bag 5. Locating the second set of perforations 220 along the fold-over line 30 allows for greater ease in folding the cover 24 over the first set of perforations 22.

As discussed above, an advantage of the chamber design is the reduced amount of force required to unseal the cover 24 from the front wall 10 as the air exits the bag 5. In this embodiment, as air is forced into the chamber 29 from the storage portion 20, the air presses up against the side of the adhesive 26 seal between the cover 24 and the front wall 10. Thus the force causing the cover 24 to become unsealed and separate from the front wall 10 is perpendicularly oriented to the direction of separation or "peel", forming a "peel angle." Conversely, in the embodiment of FIG. 1, when air is forced out of the perforations 22 it presses up against the cover 24, so that the separating force is directed parallel to the peel direction—in other words there is no "peel angle." One of ordinary skill in the art will appreciate that it takes more force overcome a broad front seal (i.e., where there is no peel angle).

Figure 8A:
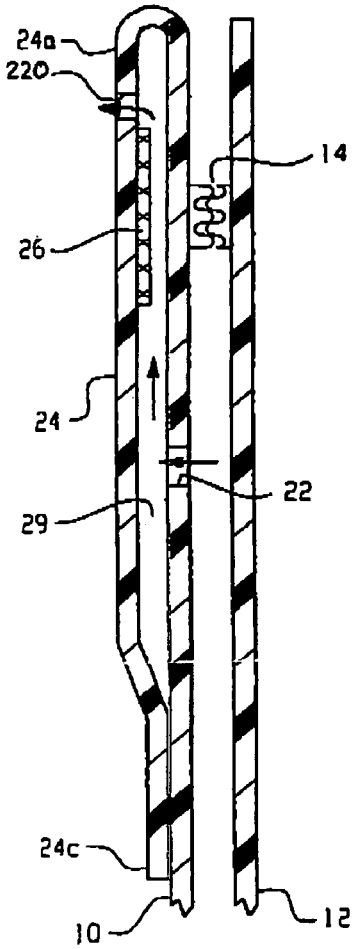
FIG. 8A is a cross-sectional view showing an alternate embodiment of the storage bag with a chamber venting structure of FIGS. 7 and 8.
Figure 8B:
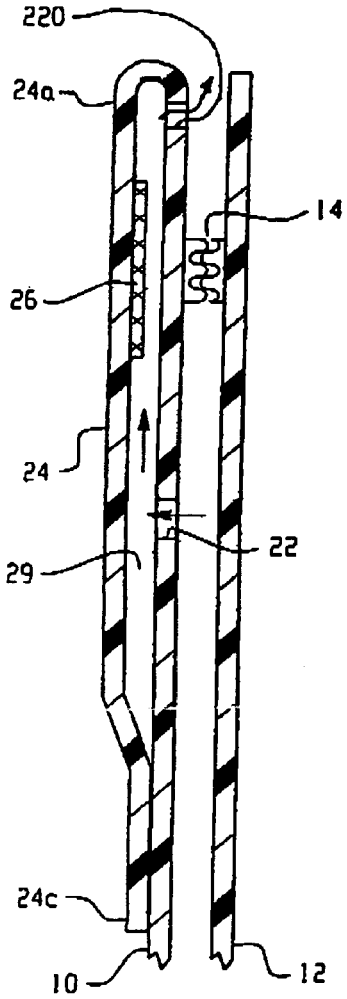
FIG. 8B is a cross-sectional view showing another alternate embodiment of the storage bag with a chamber venting structure of FIGS. 7 and 8.
Figure 8C:
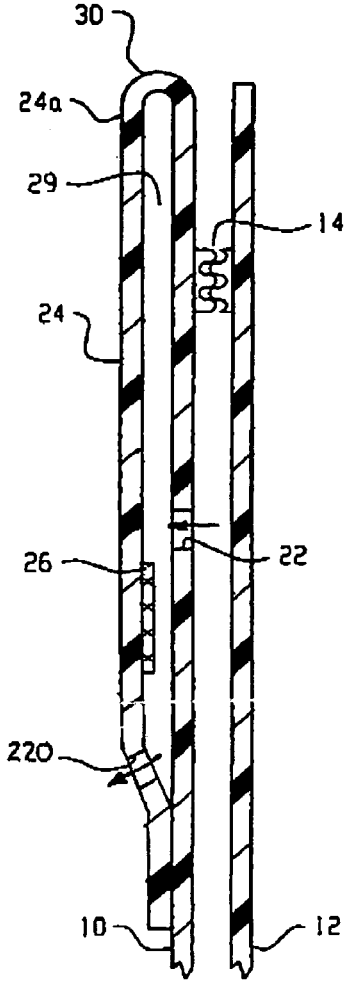
FIG. 8C is a cross-sectional view showing still another alternate embodiment of the storage bag with a chamber venting structure of FIGS. 7 and 8.

As illustrated in FIGS. 8A–C, there are several similar alternative embodiments to the one shown in FIGS. 7 and 8. For example, the second set of perforations 220 need not be located exactly along the fold-over line 30, but may instead be located anywhere in the cover 24 above the adhesive 26 (see, for example, FIG. 8A), or anywhere in the front wall 10 above both the adhesive 26 and the ILC 14 (see, for example, FIG. 8B). Also, the adhesive 26 may be permanently secured to the front wall 10 for removably sealing against the cover 24, instead of permanently secured to the cover 24 for removably sealing against the front wall 10. Additionally, the adhesive 26 need not be located exactly adjacent to the ILC 14. It may, for example, be located below the first set of perforations 22 instead of above them as shown in the Figures—in that case, the opening 28 to the atmosphere is located below the adhesive 26, either as a second set of perforations 220 (see, for example, FIG. 8C), or as a complete opening 28 (similar to the one shown in FIG. 2).

Figure 8D:
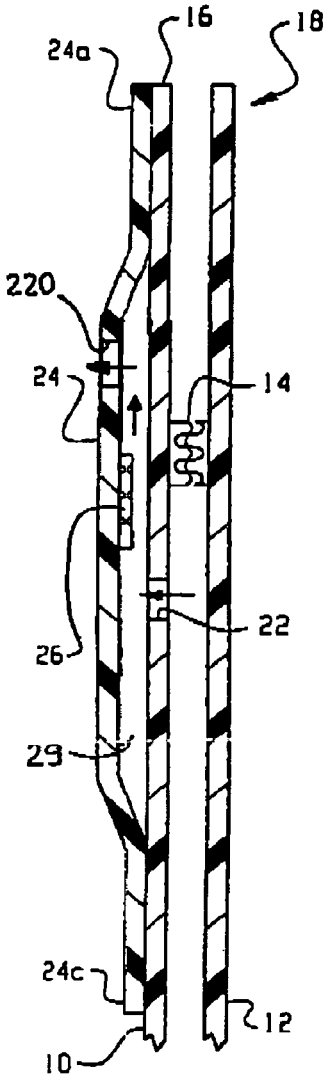
FIG. 8D is a crass-sectional view showing another alternate embodiment of the storage bag with a chamber venting structure similar to that shown in FIG. 8A except that the cover top edge 24*a* is permanently secured to, instead of being formed integral with, the flange portion 18 of the bag.
Figure 8E:
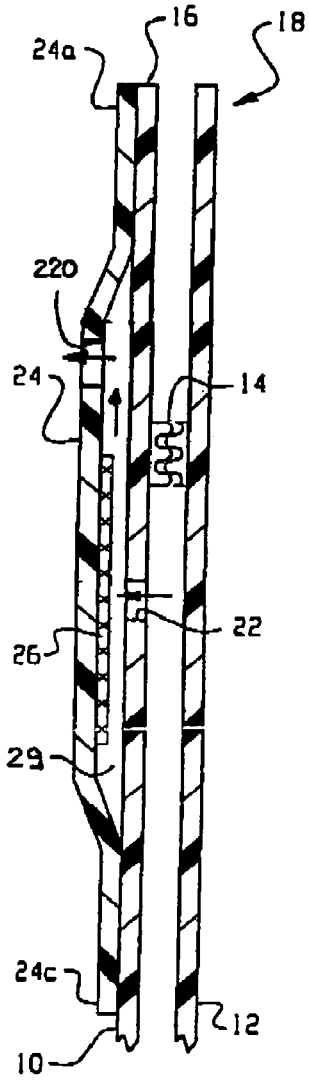
FIG. 8E is a cross-sectional view showing another alternate embodiment of the storage bag with a chamber venting structure similar to that shown in FIG. 8B except that the cover top edge 24*a* is permanently secured to, instead of being formed integral with, the flange portion 18 of the bag.
Figure 8F:
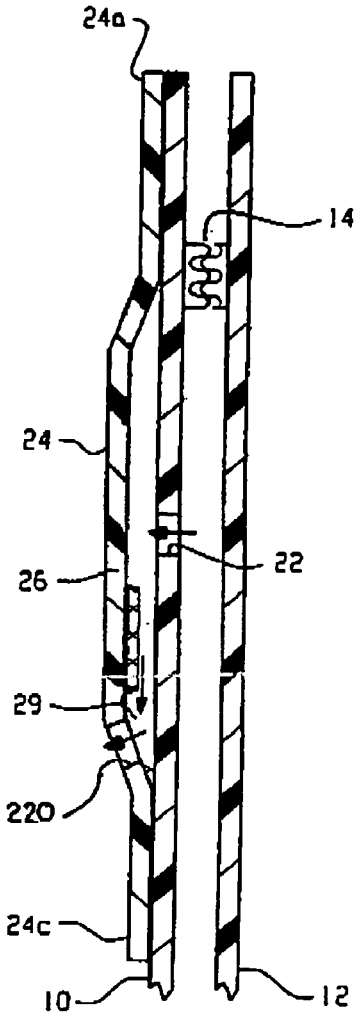
FIG. 8F is a cross-sectional view showing another alternate embodiment of the storage bag with a chamber venting structure similar to that shown in FIG. 8C except that the cover top edge 24*a* is permanently secured to, instead of being formed integral with, the flange portion 18 of the bag.

FIGS. 8D–F show alternate embodiments of the chamber design of the storage bag 5 that are similar to the series of cross-sectional views shown in FIGS. 8A–C. In the alternate embodiments shown in FIGS. 8D–F, the cover 24, instead of being formed as an integral extension of the flange portion 18 as shown in the FIGS. 8A–C, is here again formed as a separate piece of material. The cover top edge 24*a*, bottom edge 24*c* and left and right side edges 24*b* are all permanently secured to the front wall 10 of the bag 5 to define the chamber 29. As illustrated in each of the embodiment of FIGS. 8D and 8E, a second set of perforations 220 is located in the cover 24 between the adhesive 26 and top edge 24*a*. In FIG. 8E, the adhesive 26 positioned to cover the first set of perforations 22. In FIG. 8D the adhesive is positioned between the first and second set of perforations 22 and 220, respectively. As noted above, location of the adhesive 26 a distance from the first set of perforations 22 (as shown in FIG. 8D) defines a peel angle so that a lower peal force is needed to break the adhesive seal between the cover 24 and front wall 10 than is the case where the adhesive 26 is located directly over the first set of perforations 22 (as shown in FIG. 8E). As before, the adhesive 26 may be permanently secured to the front wall 10 for removably sealing against the cover 24, instead of permanently secured to the cover 24 for removably sealing against the front wall 10. As illustrated in FIG. 8F, the adhesive is located below the first set of perforations 22 and above the second set of perforations 220.

Figure 9:
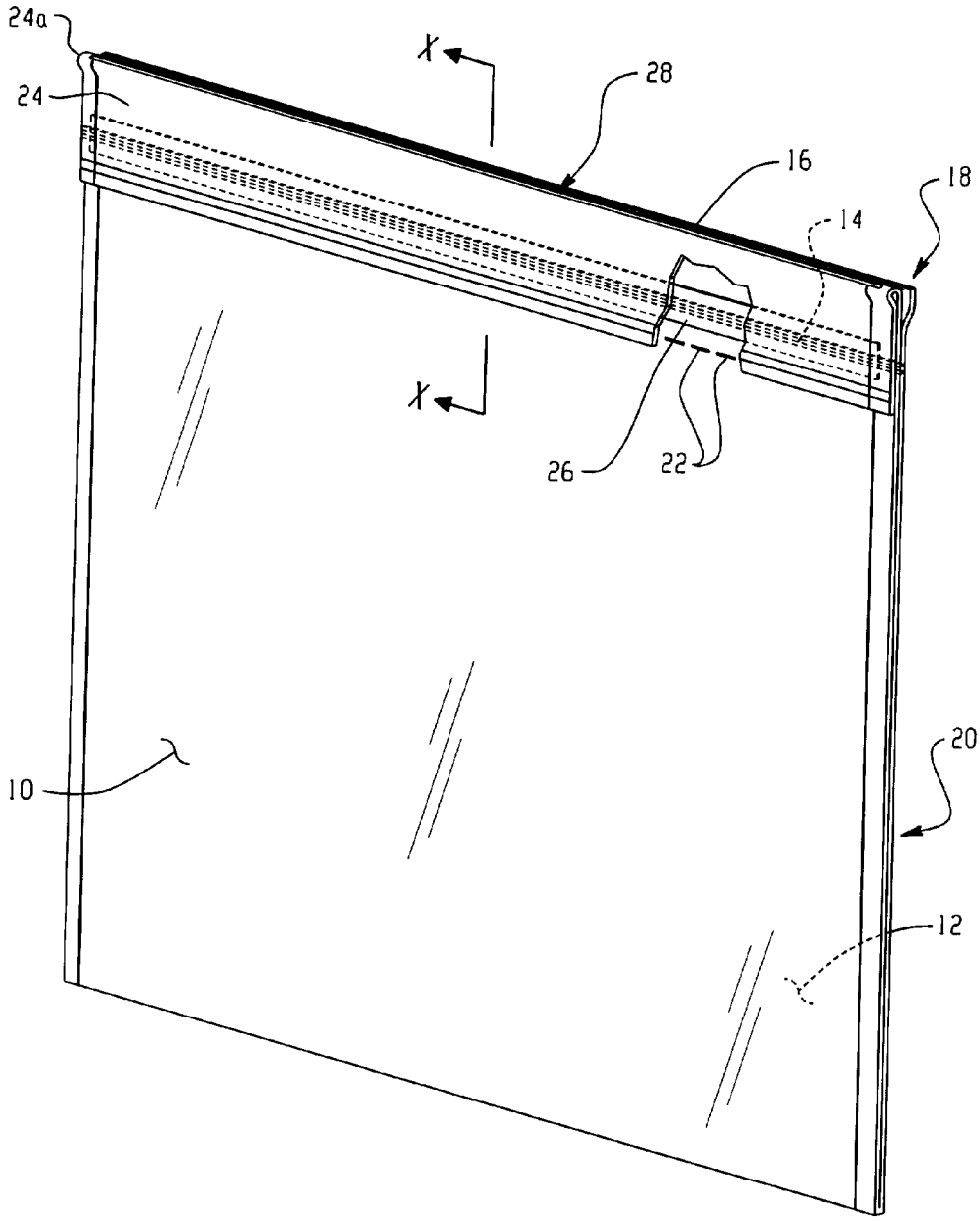
FIGS. 9 and 10 show another embodiment of a storage bag with a chamber venting structure, with FIG. 10 showing a cross-sectional view taken along line X—X of FIG. 9.
Figure 10:
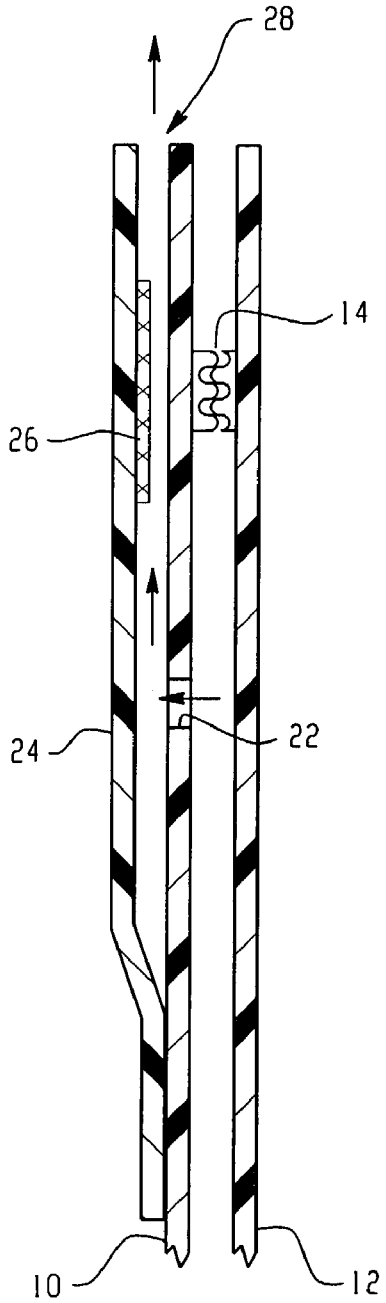

FIGS. 9 and 10 illustrate yet another embodiment of a storage bag 5. This embodiment is substantially the same as the embodiment of FIGS. 7 and 8, except that the second set of perforations 220 is one perforation extending along the majority of the top edge or terminal edge 24*a* of the cover 24. Functionally, the storage bag 5 in FIGS. 9 and 10 is substantially the same storage bag 5 in FIG. 3. However, the two bags are manufactured in different ways.

Figure 12:
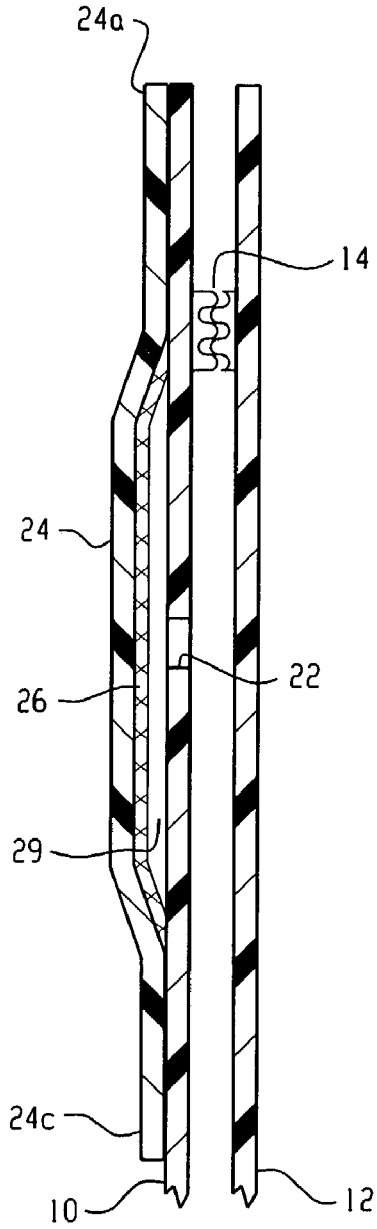
FIGS. 11 and 12 show another embodiment of a storage bag, with FIG. 12 showing a cross-sectional view taken along line XII—XII of FIG. 11.
Figure 11:
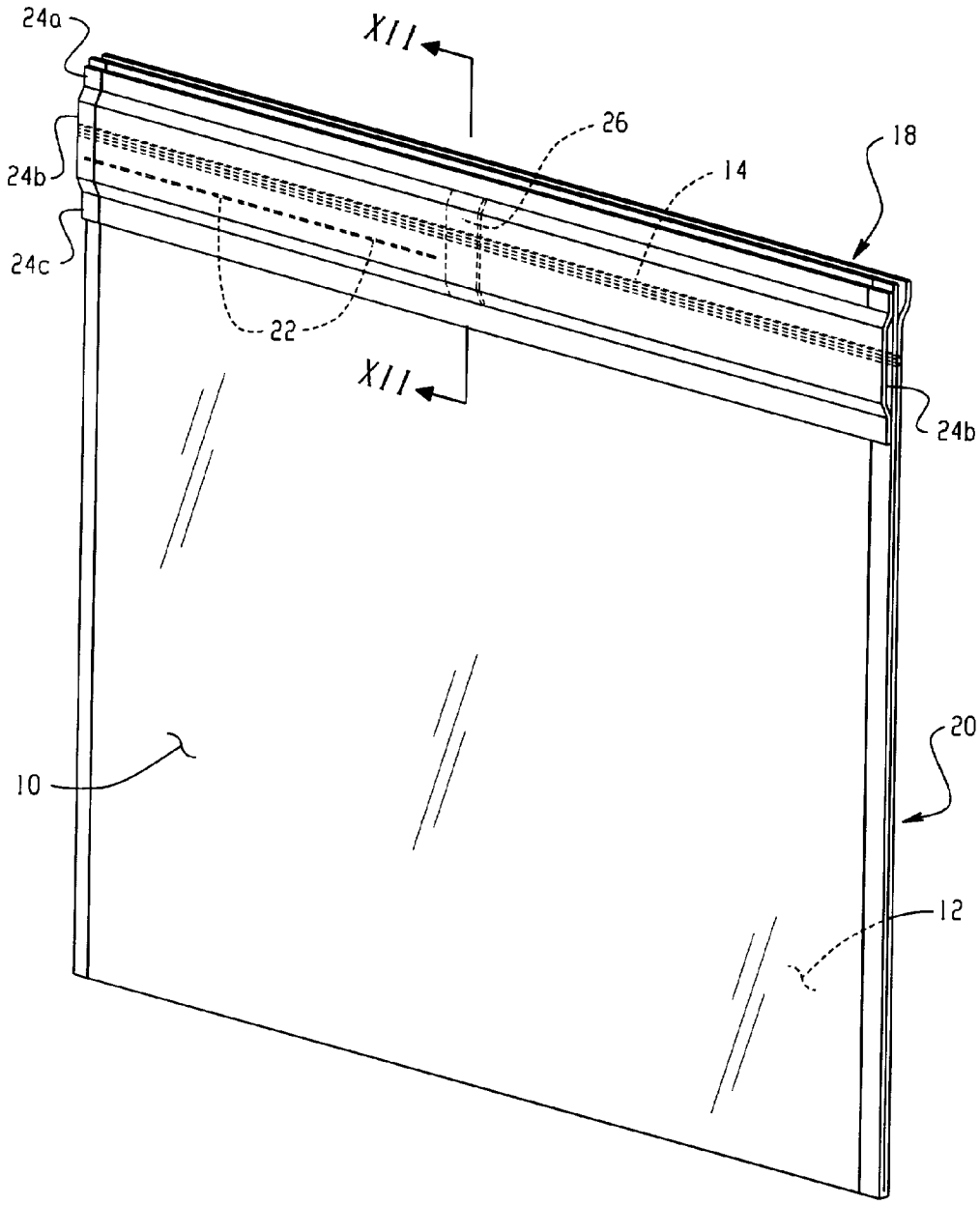
Figure 13:
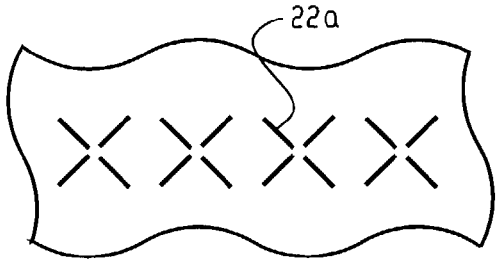
FIGS. 13–17 show alternative embodiments for the perforations.
Figure 14:
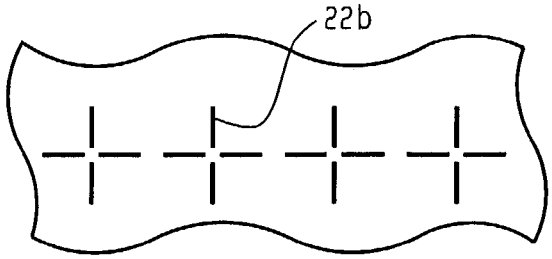
Figure 15:
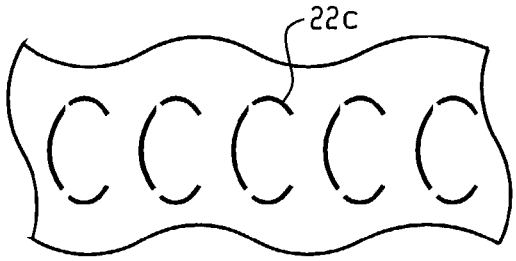
Figure 16:
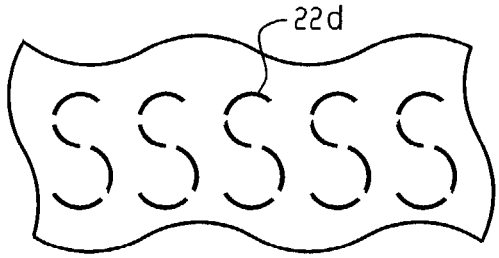
Figure 17:
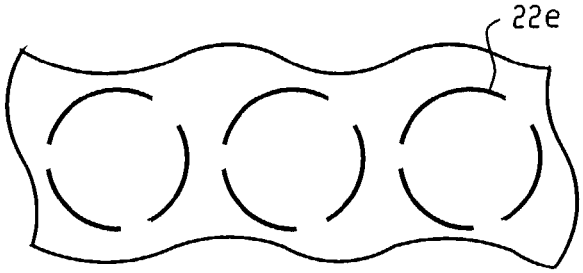

FIGS. 11 and 12 illustrate a further embodiment of a storage bag 5. In this embodiment, the top edge 24*a* and bottom edge 24*c* of the cover 24 as well as only one side edge 24*b* of the cover 24 are heat sealed, ultrasonically welded, or otherwise secured to the front wall 10. Therefore, the opening 28 to the atmosphere is at the opposite side edge 24*b* to the one that is heat sealed, ultrasonically welded, or otherwise secured to the front wall 10. The adhesive 26 is permanently secured to either the cover 24 or the front wall 10 at some point between a set of perforations 22 and the opening 28.

Figure 18:
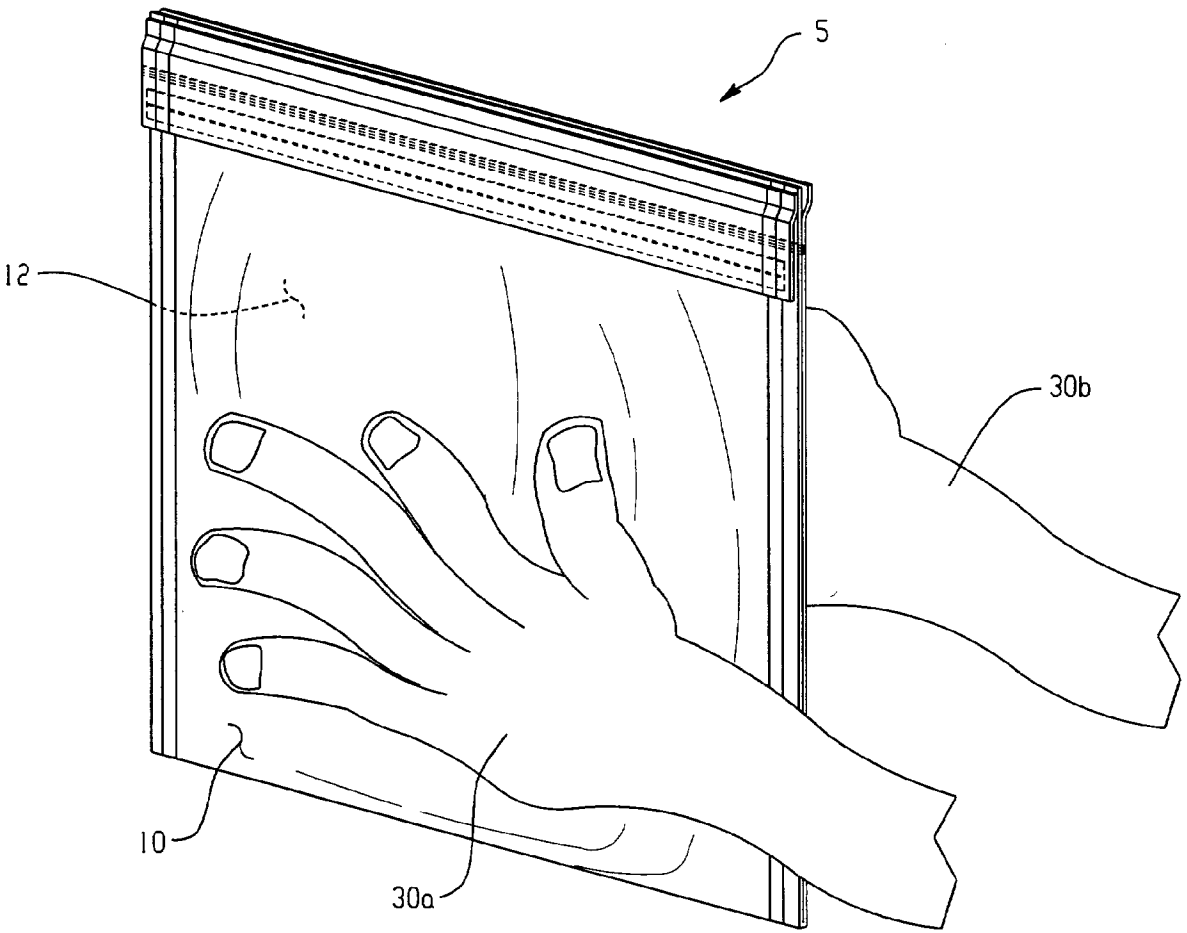
FIG. 18 shows a method of expelling excess air from the interior of a storage bag.

In order to expel excess air from inside the bag 5 the user may apply external pressure to the bag 5, typically with one hand 30*a* on the front wall 10 and the other hand 30*b* on the back wall 12, as shown in FIG. 18. The hands are moved together to push the air pressure out of the bag. Other methods may be used to expel the air pressure from the bag 5, but are not illustrated.

It is known to form small ribs extending longitudinally across a storage bag 5 in its flange portion 18. Such ribs provide easy gripping surfaces to help a user open the bag 5 when the ILC 14 is closed, and to carry the bag 5 from place to place. Such ribs may of course be utilized in any of the embodiments described here. They are most easily utilized with the embodiment of FIG. 5, however, where the bag 5 may be made as a single piece of plastic film.

Another beneficial feature of the embodiments of the storage bag 5 is placing all closing and sealing components in close proximity to each other, and in particular proximate to the opening of the bag 5. The user automatically seals the perforations 22 with the cover 24 and adhesive 26 when closing the bag 5 with the ILC 14. Even after expelling the air from the bag 5, the resealing of the cover 24 is in a familiar area to the user.

Although the invention has been described in detail with reference to certain preferred embodiments thereof, other embodiments are possible. For example, the perforations 22 and cover 24 may be placed at the bottom end or at a side of the bag 5. Therefore, the spirit and scope of the appended claims should not be limited to the description of the preferred embodiment contained herein.

What is claimed is:

1. A ventable bag for storing products comprising:

front and back walls joined at opposing sides and defining a storage space with a closed bottom end and a top end;

a re-sealable closure mechanism being operative to selectively open and close said top end;

one or more first perforations located in said front wall proximate to said top end and between said closure mechanism and said closed bottom end;

a cover positioned over said one or more first perforations; and a pressure sensitive adhesive operative to removably seal a portion of said cover to said bag;

said cover has a top edge, a bottom edge, and two side edges, at least one of said top, bottom and two side edges is permanently secured to said bag; and wherein said one or more perforations permit air to be expelled from said storage space upon at least partial removal of said cover from said bag.

2. The bag according to claim 1 wherein said top edge and said two side edges of said cover are permanently secured to said bag and at least a portion of said adhesive is positioned below said one or more first perforations.

3. The bag according to claim 2 wherein said adhesive is a material capable of sealing more than once.

4. The bag according to claim 3 wherein said adhesive is positioned on a surface of said cover facing said front wall.

5. The bag according to claim 3 wherein said adhesive is positioned on said front wall of said bag.

6. The bag according to claim 2 wherein part of said portion of said adhesive is positioned at said bottom edge.

7. The bag according to claim 2 wherein said bottom edge is permanently secured to said bag and one or more second perforations are located in said cover between said adhesive and said bottom edge.

8. The bag according to claim 2 wherein said first perforations are configured in a substantially straight line parallel to said closure mechanism.

9. The bag according to claim 1 wherein said bottom edge and said two side edges of said cover are permanently secured to said bag and a first portion of said adhesive is positioned between said one or more first perforations and said top edge.

10. The bag according to claim 9 wherein said adhesive is a material capable of sealing more than once.

11. The bag according to claim 9 wherein part of said first portion of said adhesive is positioned at said top edge.

12. The bag according to claim 11 wherein said adhesive is positioned on a surface of said cover facing said front wall.

13. The bag according to claim 11 wherein said adhesive is positioned on said front wall of said bag.

14. A ventable bag for storing products comprising:

front and back walls joined at opposing sides and defining a storage space with a closed bottom end and a top end;

a re-sealable closure mechanism being operative to selectively open and close said top end;

one or more first perforations located in said front wall proximate to said top end and between said closure mechanism and said closed bottom end;

a cover positioned over said one or more first perforations;

a pressure sensitive adhesive operative to removably seal a portion of said cover to said bag;

said one or more first perforations permit air to be expelled from said storage space upon at least partial removal of said cover from said bag;

said cover has a top edge, a bottom edge, and two side edges, wherein said bottom edge and said two side edges of said cover are secured to said bag and at least a portion of said adhesive is positioned between said one or more first perforations and said top edge; and further including one or more second perforations located in said cover between said adhesive and said top edge.

15. The bag according to claim 14 wherein said top edge is secured to said bag.

16. The bag according to claim 1 wherein said two side edges of said cover are permanently secured to said bag, a first portion of said adhesive is positioned between said one or more first perforations and said top edge and a second portion of said adhesive is positioned between said one or more first perforations and said bottom edge.

17. The bag according to claim 16 wherein part of said first portion of said adhesive is positioned at said top edge and part of said second portion of said adhesive is positioned at said bottom edge.

18. A ventable bag for staring products comprising:

front and back walls joined at opposing sides and defining a storage space with a closed bottom end and a top end;

a re-sealable closure mechanism being operative to selectively open and close said top end;

said front wall including a flange portion above said closure mechanism;

one or more first perforations located in said front wall proximate to said top end and between said closure mechanism and said closed bottom end;

a cover positioned over said one or more first perforations, said cover is an integral fold over flap extension of said flange portion of said front wall of said bag;

a pressure sensitive adhesive operative to removably seal a portion of said cover to said bag;

said one or more first perforations permit air to be expelled from said storage space upon at least partial removal of said cover from said bag.

19. The bag according to claim 18 wherein said cover has a bottom edge and two side edges, wherein said two side edges of said cover are secured to said bag and at least a portion of said adhesive is positioned between said one or more first perforations and said bottom edge.

20. The bag according to claim 19 wherein part of said portion of said adhesive is positioned at said bottom edge.

21. A ventable bag for storing products comprising:

front and back walls joined at opposing sides and defining a storage space with a closed bottom end and a top end;

a re-sealable closure mechanism being operative to selectively open and close said top end;

one or more first perforations located in said front wall proximate to said top end and between said closure mechanism and said closed bottom end;

a cover positioned over said one or more first perforations, said cover is an integral extension of said front wall of said bag;

a pressure sensitive adhesive operative to removably seal a portion of said cover to said bag;

wherein said one or more perforations permit air to be expelled from said storage space upon at least partial removal of said cover from said bag;

said cover has a bottom edge and two side edges, wherein said bottom edge and said two side edges of said cover are secured to said bag and at least a portion of said adhesive is positioned between said one or more first perforations and said bottom edge; and further including one or more second perforations located in said cover between said adhesive and said bottom edge.

22. The bag according to claim 21 wherein said bottom edge is secured to said bag.

23. A veritable bag for storing products comprising:

front and back walls joined at opposing sides and defining a storage space with a closed bottom end and a top end;

a re-sealable closure mechanism being operative to selectively open and close said top end;

said front wall including a flange portion above said closure mechanism;

one or more first perforations located in said front wall proximate to said top end and between said closure mechanism and said closed bottom end;

a cover positioned over said one or more first perforations, said cover is an integral extension of said flange portion of said front wall;

a pressure sensitive adhesive operative to removably seal a portion of said cover to said bag;

wherein said one or more perforations permit air to be expelled from said storage space upon at least partial removal of said cover from said bag; and wherein said cover has a top edge, a bottom edge and two side edges, wherein said top edge of said cover forms a fold line between said cover and said bag, said bottom edge and said two side edges of said cover are secured to said bag, at least a portion of said adhesive is positioned above said one or more first perforations, and one or more second perforations are located between said adhesive and said closure mechanism.

24. The bag according to claim 23 wherein said one or more second perforations are disposed along said fold line.

25. The bag according to claim 1 wherein said adhesive is disposed next to said one or more perforations but not over said one or more perforations, whereby a peel angle is formed when said air being expelled from said storage space impinges said pressure sensitive adhesive.

26. The bag according to claim 1 wherein said top edge, said, and one of said two side edges are permanently secured to said bag, and a second of said two side edges remaining unsecured, and a portion of said adhesive is disposed between said first perforations and said second side edge.

27. The bag according to claim 1 wherein said closure mechanism is selected from the group consisting of an interlocking closure, a closure adhesive material, and a hook and loop fastener.

28. The bag according to claim 1 wherein at least one of said first perforations is in a C-shape, an X-shape, a cross shape, or in a disconnected circle shape.

29. The bag according to claim 1 wherein said air is expelled from said storage space having an exit pressure large enough to unseal said adhesive and thereby separate said portion of said cover from said bag.

30. A bag for storing products comprising:

front and back walls joined at opposing sides and defining a storage space wit a closed bottom end and a top end;

a re-sealable closure mechanism being operative to selectively open and close said top end;

said front wall including a flange portion above said closure mechanism;

one or more perforations provided in said front wall for permitting air trapped within said storage space to escape, said one or more first perforations located between said closure mechanism and said closed bottom;

a cover positioned over said one or more first perforations for sealing said bag after air trapped within said storage space has escaped, wherein said cover is formed as an integral fold over flap extension of said flange portion of said front wall of said bag, said cover comprises a terminal edge and two side edges, said two side edges of said cover are secured to said front wall of said bag, said terminal edge being located between said one or more perforations and said closed bottom end; and an adhesive for securing at least a portion of said cover to said front wall.

31. The bag according to claim 30 wherein at least a portion of said adhesive is positioned to directly overlay said one or more perforations.

32. A bag for storing products comprising:

front and back walls joined at opposing sides and defining a storage space with a closed bottom end and a top end;

a re-sealable closure mechanism being operative to selectively open and close said top end;

said front wall including a flange portion above said closure mechanism;

one or more first perforations provided in said front wall for permitting air trapped within said storage space to escape, said one or more first perforations located between said closure mechanism and said closed bottom end;

a cover positioned over said one or more first perforations for sealing said bag after air trapped within said storage space has escaped, wherein said cover is formed as a fold over flap extension of said flange portion of said front wall of said bag, said cover comprises a terminal edge and two side edge; and said terminal edge and two side edges of said cover are secured to said front wall of said bag, said secured terminal edge being located between said one or more first perforations and said closed bottom end;

an adhesive for securing at least a portion of said cover to said front wall, said adhesive positioned between said one or more first perforations and said cop end of said bag; and one or more second perforations disposed in said cover between said adhesive and said closure mechanism.

33. The bag according to claim 32 wherein said adhesive is a material capable of sealing more than once.

34. A bag for storing products comprising:

a front wall, a back wall, and a storage space defined between said front wall and said back wall;

an opening at a top of said bag for inserting products in to said storage space;

a closure mechanism disposed near said top of said bag for closing said opening;

one or more first perforations located in said front wall proximate to said opening and beneath said closure mechanism for permitting air trapped within said storage space to escape;

a cover positioned over said one or more first perforations for sealing said bag after air trapped within said storage space has escaped, wherein said cover is a separate piece from said bag, said cover comprises a top edge, a bottom edges and two side edges, and said top edge and said bottom edge of said cover are permanently secured to said bag;

a pressure sensitive adhesive disposed between said top edge and said one or more first perforations; and one or more second perforations located in said cover and disposed between said top edge and said adhesive.

35. The bag according to claim 34 wherein a portion of said adhesive is positioned directly on top of said first perforations.

36. The bag according to claim 23 wherein said one or more second perforations are located in said flange portion between said fold line and said closure mechanism.

37. The bag according to claim 23 wherein said one or more second perforations are located in said cover between said adhesive and said fold line.

* * * * *